US006110079A

United States Patent [19]

Luedke et al.

[11] Patent Number: 6,110,079

[45] Date of Patent: Aug. 29, 2000

[54] KICK-BOXING EXERCISE DEVICE

[75] Inventors: Adam A. Luedke, Eden Prairie; Louis F. Polk, III, Excelsior; Kim M. Parmater, Minnetonka, all of Minn.

[73] Assignee: Fitness Quest, Inc., Canton, Ohio

[21] Appl. No.: 09/016,095

[22] Filed: Jan. 30, 1998

[51] Int. Cl.[7] ..... A63B 69/34

[52] U.S. Cl. ..... 482/83; 482/87; 482/90; 446/268

[58] Field of Search ..... 482/83–90; 446/268

[56] References Cited

U.S. PATENT DOCUMENTS

| | | | |
|---|---|---|---|
| 4,088,315 | 5/1978 | Schemmel . | |
| 4,818,234 | 4/1989 | Redington | 482/84 |
| 4,974,833 | 12/1990 | Hartman et al. | 482/84 |
| 5,052,683 | 10/1991 | Wang et al. | 482/90 |
| 5,330,403 | 7/1994 | Kuo | 482/83 |
| 5,624,358 | 4/1997 | Hestilow | 482/90 |
| 5,716,302 | 2/1998 | Anderson | 482/84 |
| 5,792,032 | 8/1998 | Williams et al. | 482/90 |

FOREIGN PATENT DOCUMENTS

| | | | |
|---|---|---|---|
| 2232039 | 1/1973 | Germany | 482/84 |

*Primary Examiner*—Jerome Donnelly
*Attorney, Agent, or Firm*—Sand & Sebolt

[57] ABSTRACT

A kick-boxing exercise device includes a weighted base unit which supports a target section. The target section having an appearance of a head, neck and torso of a human. The target section is vertically adjustable on the base unit and includes a plurality of target areas. A plurality of LEDs are mounted within the target areas which illuminate as the specific target areas are to be punched or kicked by a user. A foam pad is attached to the target section for cushioning the punch or kick of the user. An electronic control unit illuminates the LEDs in a preprogrammed punch or kick sequence. Various skill levels are provided to sequentially illuminate the LEDs at various speeds. The electronic control unit includes a scoring system which allows the user to evaluate his or her performance. A sensor detects contact with the target section and triggers illumination of the next LED in the sequence. A sensor adjustment dial allows the sensitivity of the sensor to be adjusted by the user.

27 Claims, 3 Drawing Sheets

KICK-BOXING EXERCISE DEVICE

BACKGROUND OF THE INVENTION

1. Technical Field

Generally, the invention relates to an exercise device. Particularly, the invention relates to an exercise device which allows a user to simulate kick-boxing. More particularly, the invention relates to an exercise device which includes a target section having the shape of a head, neck and torso of a human and a plurality of target areas located on the target section which illuminate in a sequential pattern to indicate the location which the user is to punch or kick to obtain a complete muscular and cardiovascular workout.

2. Background Information

It has long been recognized by those in the fitness industry that boxing, and particularly kick-boxing, provides an intense muscular and cardiovascular workout. The sport of kick-boxing requires strength, agility and endurance. A kick-boxer uses his or her fists and feet to punch and kick an opponent in the head or body. Throwing a punch requires the use of muscles ranging from the feet to the head and neck. Punches generate from the ground up with the kick-boxer using his or her back leg to push or thrust the upper body forward while the front leg supports this forward movement. In order to extend the punching arm, the kick-boxer rotates the upper body working the abdominal muscles while extending the punching arm to work the various muscles in the shoulders, arms and hands.

In order to kick an opponent, the kick-boxer must thrust one leg upwardly and outwardly to a height sufficient to contact the opponent in the head or torso, while supporting his or her body on one leg. Extending one's foot to a sufficient height to reach the head or torso of an opponent works the various leg and abdominal muscles and requires a great deal of flexibility and balance.

Further, while attempting to punch or kick the opponent, the kick-boxer must simultaneously avoid being kicked or punched by the opponent. The kick-boxer must be prepared to dodge the opponent's punches or kicks at any instant by balancing himself or herself on the balls of the feet. This allows the kick-boxer to quickly duck or back away from an oncoming punch or kick. This type of movement is typically known as "bobbing and weaving." The kick-boxer bobs and weaves to avoid being punched or kicked while looking an opportunity or "opening" to punch or kick the opponent. Bobbing and weaving requires a great deal of foot movement, quickness and agility.

Thus, it can be seen that throwing punches and kicks while simultaneously avoiding the punches and kicks of the opponent works virtually every muscle in the kick-boxer's body and allows the kick-boxer to improve his or her flexibility, balance, quickness and agility. The problem with using kick-boxing as a type of exercise is that most individuals do not wish to engage in actual contact with an opponent and risk being hurt by a punch or kick to the head or torso. Those who partake in kick-boxing as a sport are highly trained athletes who use state-of-the-art training equipment, safety equipment and expert instructors.

Heretofore, several devices have addressed this problem of providing a device which allows users to engage in kick-boxing as a muscular and cardiovascular workout without exposing the themselves to harm from a punch or kick of an opponent. For example, U.S. Pat. No. 4,088,315 discloses a device for self defense training having an appearance of a human and including a plurality of targets which indicate where the user is to strike the dummy. The device includes several intricate mechanical joints which allow the limbs of the dummy to be placed in various attack positions. Additionally, the device includes a pressure sensitive floor pad which the user must stand on in order to activate the illuminated targets.

U.S. Pat. No. 4,974,833 discloses an electronic martial arts training device having a two-dimensional outline of an opponent with various target modules which illuminate in a sequential pattern. The target section must be mounted on a wall or otherwise supported a sufficient height to simulate the height of an opponent. The device does not include a height adjustment mechanism and requires the user to mount the device on a wall or other support structure.

Although these devices are adequate for the purpose for which they are intended, these prior art devices requires either a substantial amount of horizontal floor space for the dummy and associated pressure sensitive floor pad or a substantial amount of wall space on which the target section must be mounted.

Therefore, the need exists for a kick-boxing exercise device which allows a user to simulate kick-boxing, which requires minimal horizontal floor space and minimal vertical wall space, and which is free of complicated mechanical joints and limbs which may break.

SUMMARY OF THE INVENTION

Objectives of the present invention include providing a kick-boxing exercise device which allows a user to obtain a complete muscular and cardiovascular workout by simulating the sport of kick-boxing without being subjected to punches or kicks.

A further objective is to provide an exercise device which is freestanding and requires no mounting or support structures.

Another objective is to provide an exercise device which has the shape of a head, neck and torso of a human to give the user a realistic human-shaped target.

A further objective is to provide an exercise device which provides various skill levels allowing the user to progressively improve his or her kick-boxing ability.

Another objective is to provide an exercise device having a scoring system which allows the user to evaluate his or her performance.

A still further objective is to provide an exercise device of simple construction, which achieves the stated objectives in a simple, effective and inexpensive manner, which solves problems and satisfies needs existing in the art.

These objectives and advantages are obtained by the exercise device of the present invention, the general nature of which may be stated as including a base having a bottom portion and a top portion which extends upwardly from the bottom portion; a target section mounted on the base, said target portion having a shape of a head, neck and torso of a human and being free of outwardly extending limbs; a plurality of targets formed on the target section; and a pad attached to the target section for cushioning an impact by a user.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
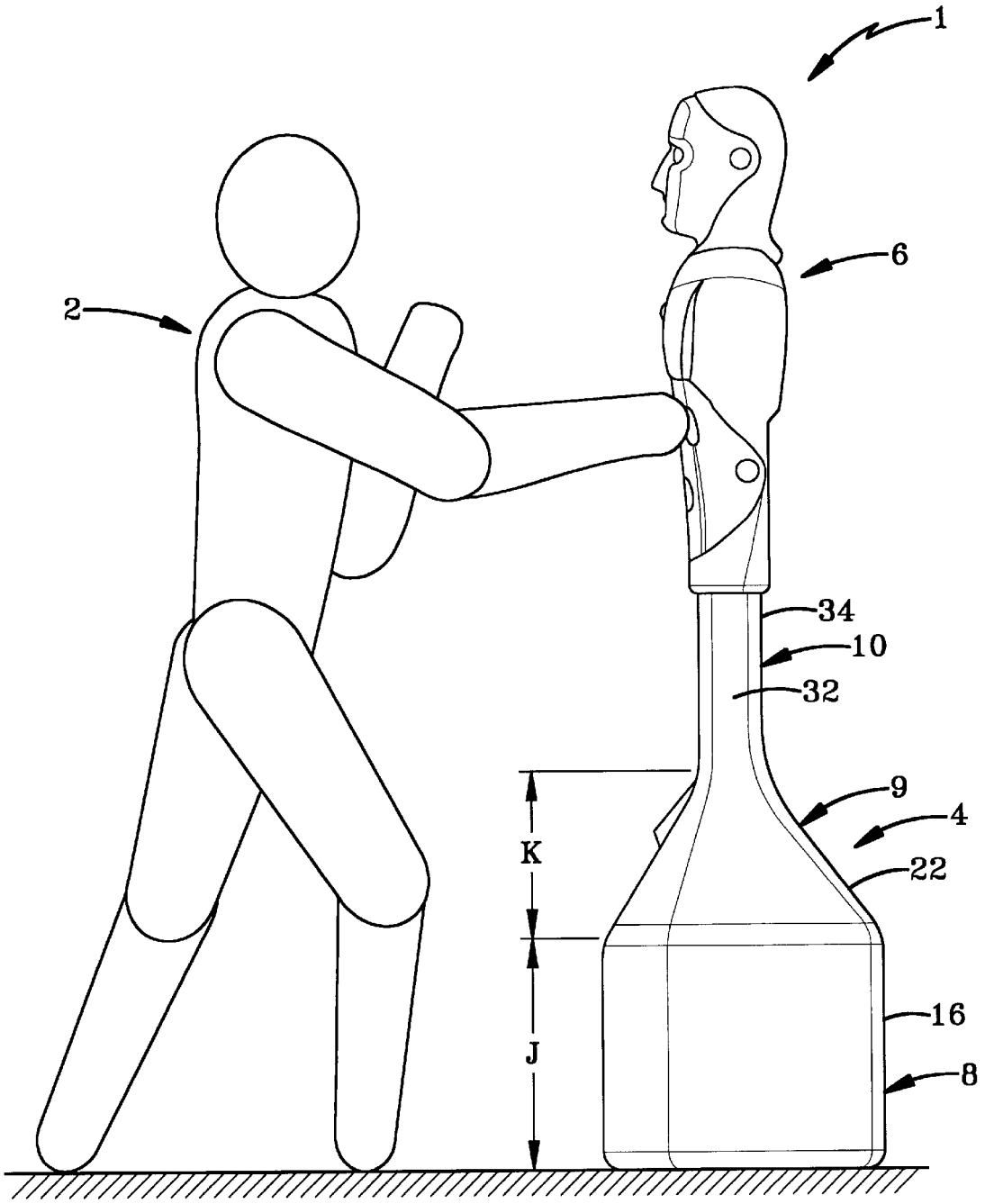
FIG. 1 is a side elevational view showing the kick-boxing exercise device of the present invention being punched by a user.

The kick-boxing exercise device of the present invention is indicated generally at 1 in FIG. 1, and is shown being punched by a user 2. Exercise device 1 includes a base unit 4 which supports a target section 6. Base unit 4 includes an enlarged bottom portion 8, a top stem 10 and a tapered middle portion 9 extending therebetween. Bottom portion 8 has a curved front wall 12 (FIGS. 2 and 3), a pair of curved sidewalls 14 and a generally straight rear wall 16 (FIG. 1). Likewise, middle tapered portion 9 includes a tapered front wall 18, a pair of tapered sidewalls 20 and a tapered rear wall 22. Walls 18, 20 and 22 of middle tapered portion 9 are formed integrally with the respective walls of bottom portion 8. A recessed area 24 is formed in tapered front wall 18 for receiving an electronic control unit 26.

Top stem 10 (FIG. 3) is a relatively narrow elongated member which extends upwardly from and is formed integrally with middle tapered portion 9 for adjustably receiving target section 6, as described below. Top stem 10 includes a front wall 28 formed with a middle channel 30 which is a continuation of recessed area 24 of middle portion 9. Top stem 10 further includes a pair of sidewalls 32, a rear wall 34 which is formed with a middle channel (not shown) similar to middle channel 30 of front wall 28 and a top wall 35. The middle channels of front and rear walls 28 and 34, respectively, form a thin plate-like center wall 36 which separates the front and rear middle channels and which is formed with an aperture 38. Aperture 38 extends generally vertically within center wall 36 and is formed with a plurality of horizontal adjustment notches 40. Adjustment notches 40 allow target section 6 to be vertically adjusted according to the height of user 2.

In the preferred embodiment, base unit 4 is formed of a plastic material such as a polypropylene having a nominal wall thickness of 0.188 inches. Base unit 4 includes a hollow interior for receiving a substance such as sand, rock salt or water, for weighting down exercise device 1 preventing movement of the exercise device when it is punched or kicked by user 2. An access opening (not shown) is formed in top wall 35 of top stem 10. A cap 42 covers the access opening to the hollow interior of base unit 4.

In the preferred embodiment, bottom portion 8 has a width measured between sidewalls 14 of approximately 19 inches, a depth measured between front and rear walls 12 and 16, respectively, of approximately 17 inches and a height J (FIG. 1) of approximately 14½ inches. Middle tapered portion 9 has a height K measured between bottom portion 8 and top stem 10 of approximately 9½ inches. Top stem 10 has a height measured between middle tapered portion 9 and top wall 35 of approximately 26⅝ inches.

In accordance with one of the features of the invention, target section 6 has a shape and configuration which emulates a head, neck and torso of a human. Target section 6 includes a head 50, a neck 52 and a lower torso 54. Target section 6 is formed of a plastic material similar to that of base unit 4, such as a polypropylene, having a nominal wall thickness of 0.188 inches.

Target section 6 is formed with a recessed area 56 in the face, neck and abdominal region thereof. Recessed area 56 receives a complementary-shaped foam pad 60 which, in a preferred embodiment, is formed of a self-skinning urethane foam. Foam pad 60 includes a face portion 62, an abdominal portion 64 and a thin neck and chest portion 66 extending between and connecting face portion 62 and abdominal portion 64. Foam pad 60 is formed with a plurality of holes 68 having a countersunk portion 70. A plurality of holes 72 are formed in target section 6 which align with holes 68 when foam pad 60 is placed within recessed area 56. A clip 74 extends through holes 68 of foam pad 60 and snap-fits with holes 72 of target section 6 to retain foam pad 60 within recessed area 56.

In accordance with another of the features of the invention, target section 6 includes eight indented target areas which are formed in target section 6 at strategic punching or kicking locations. Specifically, the target areas are located at a right eye area A, a left eye area B, a mouth area C, a chest or sternum area D, a right rib cage area E, a left rib cage area F, a right abdominal area G and a left abdominal area H. Each target area includes an LED which illuminates when the specific target area is to be struck by user 2. A wiring channel 76 is formed between the target areas for receiving the electrical wiring which supplies power to the LEDs. A plurality of openings 78 are formed in foam pad 60 which correspond to and align with target areas A–H and allow the LED to be seen therethrough when foam pad 60 is attached to target section 6.

A sensor switch adjustment dial 80 is positioned on the chest area of target section 6 and extends outwardly from recessed area 56 thereof. Dial 80 allows the sensitivity of a motion sensor or tilt switch, described below, to be adjusted according to the punching strength of user 2. A cutout area 82 is formed in foam pad 60 which allows adjustment dial 80 to extend through foam pad 60.

Electronic control unit 26 includes various buttons and displays which allow the user to adjust the skill level of kick-boxing exercise device 1, activate a digital timer, or select a specific target area which is to be illuminated or select one of several preprogrammed punching sequences.

Figure 2:
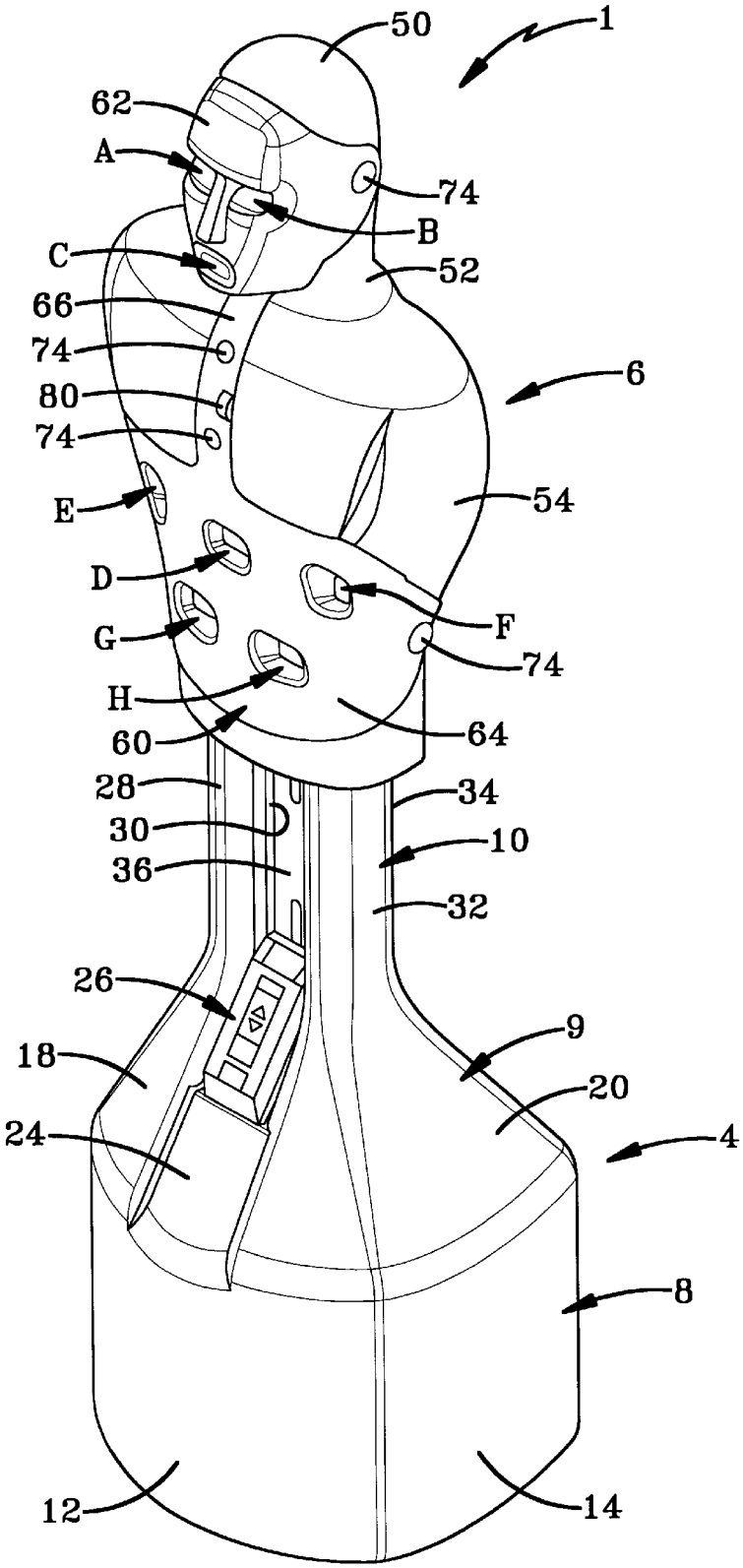
FIG. 2 is a top perspective view of the kick-boxing exercise device of FIG. 1.
Figure 3:
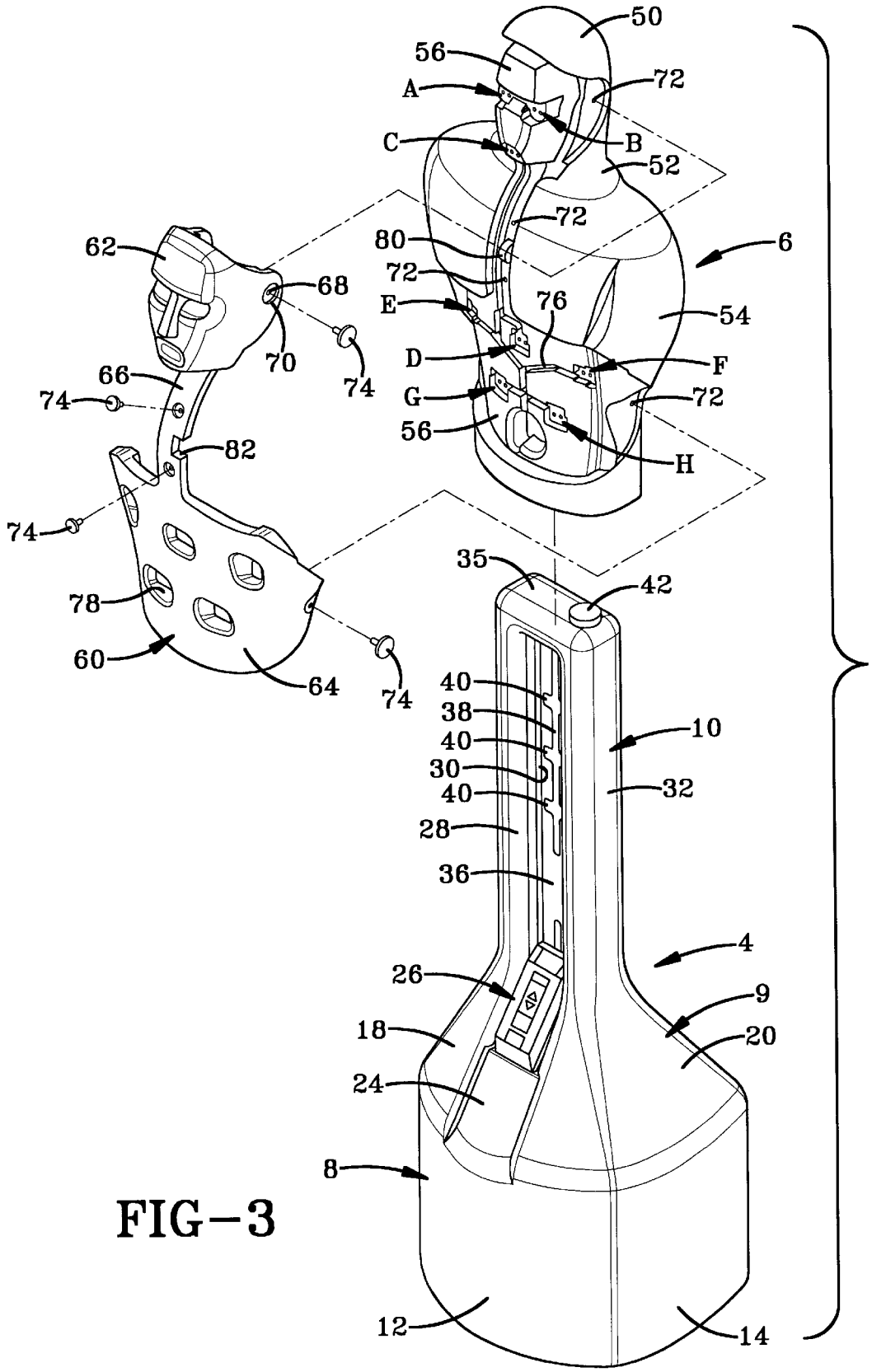
FIG. 3 is an exploded perspective view of the exercise device of FIG. 2.

Exercise device 1 is shown in FIG. 2 in an assembled position. Foam pad 60 is attached within recessed area 56 and is flush with the outer surface of target section 6. Clips 74 extend through holes 68 and snap-fit with holes 72 to retain foam pad 60 within recessed area 56 of target section 6. Cap 42 is removed from the top end of stem 10 allowing sand, rock salt or some other suitable material to be poured within the hollow interior of base unit 4 for preventing kick-boxing machine exercise device 1 from moving during use. Cap 42 is screwed or snap-fit over the opening of stem 10. An opening (not shown) is formed in the bottom of target section 6 for receiving top stem 10 of base unit 4. An adjustment mechanism is positioned on the rear of target section 6 which slides within aperture 38 for releasably latching with one of the levels of notches 40.

In use, user 2 adjusts target section 6 to a height approximately the same height as the user. User 2 positions his or her body a distance away from kick-boxing exercise device 1 whereby full extension of the user's arms or legs will produce contact with but will not knock over kick-boxing exercise device 1. Electronic control unit 26 is turned on and one of several punching sequences may be activated or one specific target area may be selected by the user.

In the preferred embodiment, the punching sequences are grouped in two to three punch or kick combinations. One example of a punching sequence is A-B, E-A, A-B, A-C, A-A, E-F, D-H-C, whereby each letter of the punch or kick sequence corresponds to the lettered target areas of FIGS. 2 and 3. In the preferred embodiment, the user will obtain a maximum muscular and cardiovascular workout by repeating each punching sequence for a total of three minutes alternating right and left hands or feet. The LEDs of each target area are illuminated when the user is to contact that particular location of target section 6. Foam pad 60 cushions the user's fists or feet to prevent injury when the user punches or kicks exercise device 1.

The speed in which the LEDs are illuminated in each sequence is determined by the skill level selected on electronic control unit 26. The advanced skill level includes a scoring system which allows user 2 to evaluate his or her performance. During this advanced skill level, the LEDs of each target area are sequentially illuminated, as with the beginner and intermediate skill levels, but control unit 26 will not illuminate a subsequent LED until the sensor or tilt switch detects that contact has been made with the currently lit LED. Additionally, a speaker may be provided within control unit 26 which beeps when an LED is illuminated. This advanced skill level allows the user to monitor the number of punches thrown within a specific amount of time allowing the user to track his or her quickness and reaction time.

Further, dial 80 may be adjusted to vary the force of the punches or kicks required to "trip" the sensor or tilt switch and activate the next LED. This allows the user to monitor his or her punching strength as the user is able to require that harder punches be thrown in order to trip the sensor or tilt switch.

Accordingly, exercise device 1 allows a user to simulate the sport of kick-boxing without being subjected to harm from an opponents punches or kicks. Base unit 4 supports target section 6 allowing exercise device 1 to be freestanding and easily movable for storing device 1 in a closet or corner. Hollow base unit 4 allows exercise device 1 to be shipped at a relatively low cost, yet provides an access opening which allows the user to add weight to the base to prevent movement of the device during use. Target section 6 is vertically adjustable on base unit 4 allowing the user to position human-shaped target section 6 to various heights depending on the height of the user. Foam pad 60 cushions the punches and kicks of the user to prevent injury to the user's hands and feet. Target areas A–H are provided with an LED which illuminates when the user is to punch or kick a specific target area. Electronic control unit 26 provides several skill levels which allow the user to evaluate his or her progress and performance.

Accordingly, the improved kick-boxing exercise device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved kick-boxing exercise device is constructed and used, the characteristics of the construction, and the advantageous, new and useful results obtained, the new and useful structures, devices, elements, arrangements, parts and combinations, are set forth in the appended claims.

What is claimed is:

1. A kick-boxing exercise device including:

a base having a bottom portion and a top portion which extends upwardly from the bottom portion whereby the base is adapted to accept a quantity of weighted material therein;

a target section mounted on the base, said target section having a three-dimensional shape of a head, neck and torso of a human and being free of outwardly extending limbs;

a plurality of targets formed on the target section;

a pad attached to the target section for cushioning an impact by a user;

a light mounted in each of said targets and recessed below the outer surface of said pad;

an electronic control unit operatively connected with and controlling said lights; and a sensor operatively connected with said electronic control unit.

2. The exercise device of claim 1 in which the target section is vertically adjustable on the base.

3. The exercise device of claim 2 in which the target section receives the top portion of the base for mounting the target section on said base.

4. The exercise device of claim 1 in which each target includes an opening formed in the target section.

5. The exercise device of claim 4 in which the lights are light emitting diodes.

6. The exercise device of claim 4 in which the pad is formed with a plurality of openings, said openings of the pad correspond in number and align with the openings of the target section.

7. The exercise device of claim 1 in which the targets are located at right and left eye areas, a mouth area, a chest area, right and left rib areas, and right and left abdominal areas of the target section.

8. The exercise device of claim 1 in which the pad is a foam pad.

9. The exercise device of claim 8 in which the pad is formed of a self-skinning urethane foam.

10. The exercise device of claim 1 in which the target section is formed of a plastic.

11. The exercise device of claim 10 in which the target section is formed of a polypropylene.

12. The exercise device of claim 1 further including a sensor mounted on the target section for sensing the impact.

13. The exercise device of claim 11 further including a sensor sensitivity adjustment mechanism for adjusting the sensitivity of the sensor.

14. An exercise device including:

a base adapted to accept a quantity of weighting material therein;

a three-dimensional target section having an appearance which resembles a head, neck and torso of a human; the target section being adjustably mounted on the base;

a plurality of targets formed on the target section;

a pad attached to the target section for cushioning an impact by a user;

a light mounted in each of said targets and recessed below the outer surface of said pad;

an electronic control unit operatively connected with and controlling said lights; and a first sensor operatively connected with said electronic control unit.

15. The exercise device of claim 14 in which an electronic control unit controls illumination of the lights.

16. The exercise device of claim 14 in which the pad is formed with a plurality of openings which align with the targets for allowing the lights of the targets to illuminate therethrough.

17. The exercise device of claim 14 in which the targets are located at right and left eye areas, a mouth area, a chest area, right and left rib areas, and right and left abdominal areas of the target section.

18. The exercise device of claim 14, wherein the base includes a top stem portion having an elongated aperture and a plurality of spaced notches extending from the elongated aperture; the target section having an adjustment mechanism slidably engaging the aperture and latchingly engaging one of the notches.

19. The exercise device of claim 14, wherein the target section includes a first portion and a second portion; the first portion being formed from a first material and the second portion being formed from a second material; the first portion having a recessed area that receives the second portion; the second material being substantially softer than the first material; and the second portion being substantially flush with the first portion at the edges of the recessed area.

20. The exercise device of claim 14, wherein the first sensor controls the activation of each of the plurality of targets.

21. The exercise device of claim 14, wherein the control unit is mounted on the base.

22. The exercise device of claim 21, wherein the base includes an enlarged bottom portion, a top stem portion, and a tapered middle portion extending between the bottom portion and the top stem portion;

the tapered middle portion including a front wall, a rear wall and a pair of sidewalls connecting the front wall to the rear wall;

the front wall having a recessed area; and at least a portion of the control unit being disposed in the recessed area of the front wall of the tapered middle portion of the base.

23. An exercise device comprising:

a base having a cavity;

the base and cavity adapted to accept a quantity of weighting material;

the base having an enlarged bottom portion, a top stem portion, and a tapered middle portion extending between the bottom portion and the top stem portion;

the tapered middle portion including a front wall, a rear wall and a pair of sidewalls connecting the front wall to the rear wall;

the front wall having a recessed area;

the top stem portion having a front wall, a rear wall, and a pair of sidewalls connecting the front wall to the rear wall;

the front wall and rear wall of the top stem portion each having a middle channel;

the middle channel in the front wall of the top stem portion being a continuation of the recessed area of the front wall of the tapered middle portion;

the middle channels of the front and rear walls of the top stem portion forming a plate-like center wall;

the center wall having an elongated aperture having a plurality of spaced adjustment notches;

a three-dimensional target section having an appearance which resembles a head, neck, and torso of a human;

the target section being mounted on the top stem portion of the base;

a plurality of targets formed on the target section;

a pad attached to the target section for cushioning an impact by a user;

a light mounted in each of said targets and recessed below the outer surface of said pad;

an electronic control unit operatively connected with said lights;

a sensor operatively connected with said electronic control unit; and the electronic control unit being at least partially disposed in the recessed area of the front wall of the tapered middle portion of the base.

24. The exercise device of claim 23, wherein the target section is vertically adjustable on the base.

25. The exercise device of claim 24, further comprising an adjustment mechanism slidably engaging the aperture and latchingly engaging one of the notches.

26. The exercise device of claim 23, wherein the electronic control unit controls the illumination of the lights.

27. The exercise device of claim 26, wherein each of the lights are light emitting diodes.

* * * * *